United States Patent [19]

Mitchell

[11] Patent Number: 4,863,108

[45] Date of Patent: Sep. 5, 1989

[54] ANIMAL EXCREMENT DISSOLVER

[76] Inventor: William D. Mitchell, 10655 Morada Dr., Orange, Calif. 92669

[21] Appl. No.: 280,671

[22] Filed: Dec. 6, 1988

[51] Int. Cl.[4] ..... B02C 18/00

[52] U.S. Cl. ..... 241/168; 241/41; 239/271

[58] Field of Search ..... 241/39, 41, 168, 169.2; 239/271, 288.5, 754

[56] References Cited

U.S. PATENT DOCUMENTS

| | | | |
|---|---|---|---|
| 2,928,610 | 3/1960 | Fenimore | 239/288.5 |
| 3,756,514 | 9/1973 | Brown | 239/288.5 |
| 3,770,204 | 11/1973 | Schuster | 239/288.5 |

*Primary Examiner*—Timothy V. Eley
*Attorney, Agent, or Firm*—William L. Chapin

[57] ABSTRACT

An apparatus for breaking up, dissolving and flushing away animal excrement left on the ground or lawn includes a hollow cylindrical handle section coupleable to a garden hose at its upper end, and terminating in a hollow, frusto-conically shaped spray head at the lower end of the handle section. The spray head includes a hollow exterior shell section, and an orifice plate transversely positioned within the hollow interior space of the shell sections, the orifice plate having plurality of regularly spaced orifices whose entrance openings communicate with pressurized water introduced into the upper end of the shell section by the handle section, and whose lower exit openings produce streams of water at various angles adapted to efficiently break up a pile of animal excrement. Spikes protruding perpendicularly downwards from the lower surface of the plate and extending below the lower annular wall surface of the spray head shell provide a mechanical breaking action when vertically and/or rotationally impacted against a pile of animal excrement, to assist the hydrodynamic ablation action of the water jets.

19 Claims, 2 Drawing Sheets

ANIMAL EXCREMENT DISSOLVER

BACKGROUND OF THE INVENTION

1. Field of the Invention

This invention relates to devices for the diposal of animal excrement left as droppings on the ground. More particularly the invention relates to a device for dissolving animal droppings left on the ground and converting the droppings into a solution which may be used as fertilizer.

2. Description of Background Art

The pet population in the United States and other countries is large and increasing in size. At the same time, the amount of open land available for pets such as dogs to exercise is decreasing as the human population increases. This shortage of exercise space is particularly acute in large metropolitan areas.

Because of the lack of toilet facilities for city dogs, particularly on long treks with their masters, dog owners have from time immemorial allowed their dogs to use municipal properties such as streets and parks as convenient locations for their dogs to relieves themselves.

Responding to the unpleasant and unhygienic aspects of dog droppings being deposited on city property, many cities have enacted ordinances requiring the owner of a dog who has left droppings on that property to remove the droppings.

In spite of the best efforts of municipalities to legislate away the problem of offensive dog droppings being left on public property, the problem still exists for various reasons. For example, some people are either unaware of regulations controlling the disposition of droppings left by their dog, or choose to ignore the regulations. Thus, as with any such regulation, it is unrealistic to expect one-hundred percent compliance. Also many dogs run free in some cities, contributing to the problem of noxious dog droppings.

Homeowners as well as municipal authorities must contend with the problem of unwanted dog droppings. Whether or not one is overly fastidious about the general appearance of his lawn, the sight and smell of a maladorous heap left by the neighbor's dog on one's lawn is an unpleasant, and all too frequent, experience.

When confronted by such an unpleasant spectacle as described above, the occupant of the property adjacent the violated area of lawn has basically two choices. He or she may choose to ignore the pile, allowing the combined action of insects, bacteria, fungi and flies, and the drying action of air, to biodegrade the pile. However, this process can take days or weeks, prolonging the unpleasantness of having a pile of animal excrement in close proximity to an inhabited structure. Moreover, the pile of animal excrement typically draws flies, and may be inadvertently stepped in by children or adults. Also, the organic chemicals present in animal excrement, although rich in nitrogen and possessing potentially beneficial fertilizing capabilities when diluted, can "burn" the lawn when left in a concentrated pile, leaving an unsightly brown spot in the lawn after the pile has biodegraded.

For the reasons mentioned above, a person whose lawn has been soiled by an errant dog often choose to promptly remove and dispose of the dog's droppings. Anyone who has been required to perform this cleanup operation can appreciate how unpleasant this task can be.

In response to a perceived need for a more desirable method of disposing of dog droppings, a number of devices have been proposed. For example, Zimmerman, in U.S. Pat. No. 3,753,408, Aug. 21, 1973, disclosed a "Hydro Disintegrator" for disintegrating aminal droppings by the combined action of impacting pins and water pressure. The device employs a spiked plate vertically reciprocateable within a cylindrical shield, a plurality of radially disposed water nozzle outlets for directing streams of water horizontally against the spikes to clean them, and a single, central vertically disposed nozzle outlet for directing a stream of water downwards, for the stated purpose of dissolving and dispersing droppings. Miller, in U.S. Pat. No. 3,968,937, July 13, 1976, "Dropping Disposing," discloses a device for fluidizing animal droppings. Other U.S. patents using streams of water for lawn care include, Gunn, 1,979,541, Nov. 6, 1934, "Fertilizer Distributor," and Peters, 3,464,629, Sept. 2, 1969, "Grass and Weed Eradicating Spray Unit."

The present invention was conceived of to provide an improved device for dissolving animal droppings deposited on the ground, and for converting the droppings into a solution which has beneficial fertilizer properties when absorbed by soil.

OBJECTS OF THE INVENTION

An object of the present invention is to provide a device for breaking up and dissolving droppings of solid animal excrement. Another object of the invention is to provide an animal excrement dissolver which is effective in fluidizing animal droppings left on lawns and gardens into a solution having desirable fertilizing properties for plants growing in the soil.

Another object of invention is to provide an animal excrement dissolver which functions effectively without having any moving parts.

Another object of invention is to provide an animal excrement dissolver which is of simple and efficient design, and inherently inexpensive to fabricate.

Various other objects and advantages of the present invention, and its most novel features, will be particularly pointed out in this disclosure.

It is to be understood that although the invention disclosed herein is fully capable of achieving the objects and providing the advantages mentioned, the structural and operational characteristics of the invention described herein are merely illustrative of the preferred embodiments. Accordingly, I do not intend that the scope of my exclusive rights and privileges in the invention be limited to the details of construction and operation described. I do intend that reasonable equivalents, adaptions and modifications of the invention described herein be included within the scope of the invention as defined by the appended claims.

SUMMARY OF THE INVENTION

Briefly stated, the present invention comprehends a device for disposing of animal excrement left on the ground, by breaking up and flushing away the droppings. The animal excrement dissolver according to the present invention, includes an elongated hollow tubular handle section having at an upper end a coupling for connecting to a garden hose, and at the lower end of the handle section, a hollow bell shaped spray head.

The spray head consists of a hollow, bell shaped thin-outer wall spray head shell section containing a circular plate section of generally uniform thickness fastened coaxially inside the spray head shell section, near the upper, smaller diameter end of spray head shell wall section. The plate section is positioned transversely to the longitudinal axis of the outer wall section, and contains a plurality of apertures through the thickness dimension of plate. The apertures communicate at their upper entrance openings with a hollow water conduit space formed above the plate. In turn, the hollow water conduit space communicates with a hollow cylindrical neck section at the upper end of the outer wall section. The hollow handle section is in turn sealingly connected to the upper neck section of the spray head and is used to conduct water under pressure from a garden hose to perforations in the plate.

The perforations in the plate are so constructed as to provide a spray pattern of pressurized water which is effective in breaking up and dissolving animal excrement and flushing it away from the head, without splashing the user. A plurality of spikes extending downward from the bottom surface of the plate may be vertically and rotationally impacted against hard excrement, providing a mechanical breaking action to augment the hydrodynamic ablation action of the water jets. The spikes extend a slight distance below the bottom annular wall of the bell-shaped spray head shell section, spacing that wall a corresponding distance above the surface of the ground, and thereby providing a passageway for fluidized excrement. Appropriately diluted, the fluidized excrement flowing radially outwards from underneath the lower annular wall of the spray head constitutes an effective fertilizer for ground on which the device is used.

BRIEF DESCRIPTIONS OF THE DRAWINGS

DETAILED DESCRIPTION OF THE INVENTION

Figure 1:
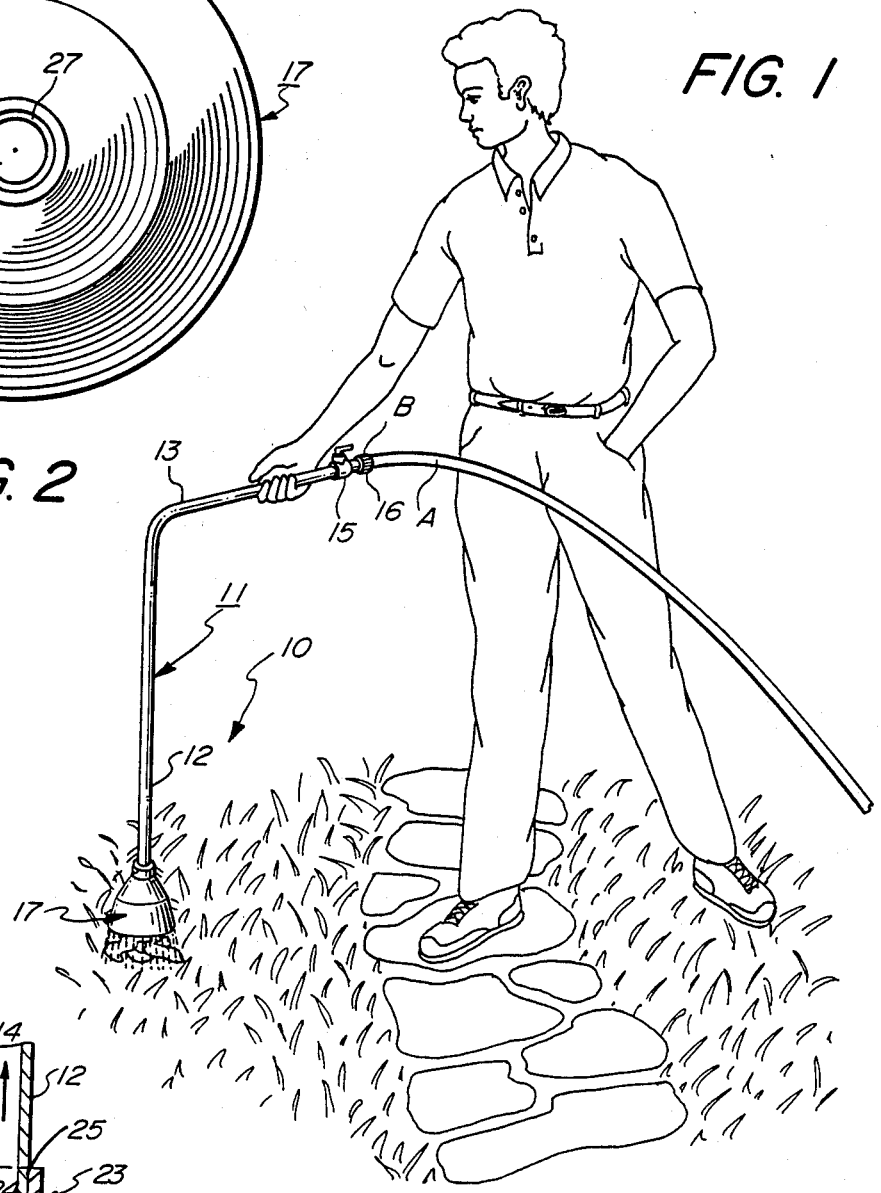
FIG. 1 is a perspective view of an excrement dissolver according to the present invention, showing the device in use.

Referring now to FIGS. 1 through 8, a novel animal excrement dissolver according to the present invention is shown:

As shown in FIG. 1, the animal excrement dissolver 10 according to the present invention includes an elongated hollow tubular handle section 11 of generally uniform outer diameter. Preferably, handle section 11 has a straight lower section 12 which is generally vertically oriented during the use of dissolver 10, and an angled upper section 13 which is generally horizontally positioned during operation of dissolver. Handle section 11 is preferably fabricated from a light weight, durable material such as PVC tubing.

The angled upper section 13 of the elongated hollow tubular handle section 11 has attached to its outer end means for introducing water under pressure into a hollow bore or water duct 14 which extends through the entire length of the handle section. Preferably, these means include a tubular shutoff value section 15 sealingly coupled at its outlet port to the outer end of angled upper section 13, the inlet port of the shutoff valve being connected to a female garden house coupling 16. Hose coupling 16 is provided to permit connecting the dissolver 10 to a standard garden hose A having a male coupling B. Preferably, hose coupling 16 is of the type permitting swiveling about its longitudinal axis, to permit easier connection to a garden hose. Optionally, hose coupling 16 may contain a standard filter screen held in place by a standard hose washer, to intercept dirt particles which might otherwise clog orifices in the spray head, which described below.

As shown in FIG. 1, the lower end of the straight lower section 12 of tubular handle section 11 terminates in a frusoconic, or generally bell-shaped, spray head 17. As may be seen best by referring to FIG. 2, spray head 17 is circularly symmetric in plan view, and coaxially located relative to the lower tubular handle section 12.

Figure 2:
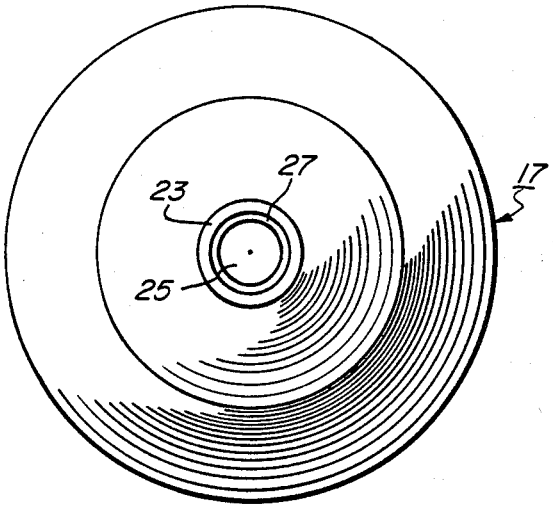
FIG. 2 is an upper plan view of a spray head shell forming the working head of the device shown in FIG. 1.
Figure 3:
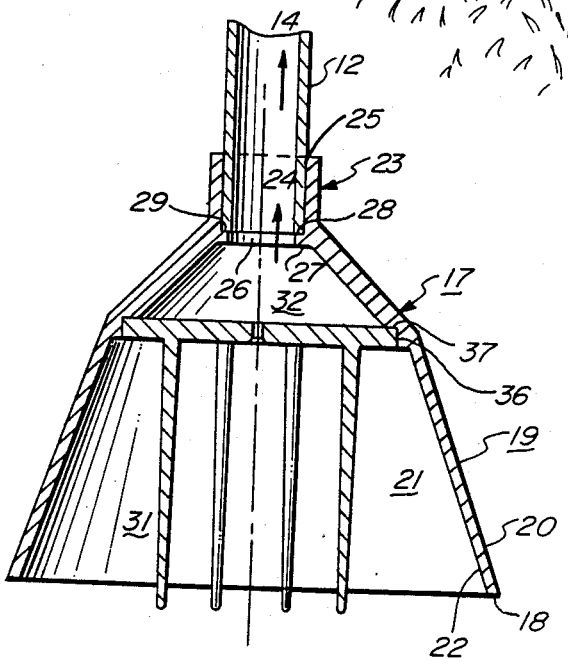
FIG. 3 is a longitudinal sectional view of the spray head shell of FIG. 2, taking alone line 3—3 of that figure.

As shown in FIGS. 1, 2 and 3, spray head 17 is flared outwardly and downwardly to terminate in a transverse lower annular wall 18 of substantially greater diameter than the outer diameter of the lower tubular handle section 12. As may be seen best by referring to FIG. 3, the spray head 19 includes a one-piece shell section 19 of relatively thin wall thickness. The outer wall surface 20 of the shell section 19 comprises the outer surface of the spray head. A concave frusto-conic space 21 is formed adjacent the inner wall surface 22 of the shell section 19.

As shown in FIG. 3, the upper end of spray head shell section 19 includes an integrally formed, upwardly extending hollow cylindrical boss section 23. Boss section 23 is coaxial with the lower frusto-conically shaped portion of the spray head shell, and has a coaxial bore 24 having an upper opening 25 and a lower opening 26.

Lower opening 26 of bore 24 of boss section 23 communicates with the hollow interior space 21 of spray head shell section 19. The upper opening of bore 26 is adapted to insertably receive the lower portion of lower tubular handle section 12.

An annular shaped flange 27 positioned longitudinally at the lower end of bore 24 of boss section 23 projects radially inwardly into lower opening 26 of the bore. Annular flange 27, which is preferably integrally formed with spray head shell section 19, has a smaller inner diameter than the outer diameter of the lower tubular handle section 12. Thus, the upper annular surface 28 of annular flange 27 forms a shoulder surface on which the lower annular wall surface 29 of lower tubular handle section 12 may seat when the latter is inserted into bore 24 of boss section 23.

After the lower tubular handle section 12 is thus positioned in base 24 of boss 23 as described above, the two parts are sealingly fastened together by any suitable means. Desirably, spray head shell section 19 is molded in a single piece from plastic such as PVC, ABS, or styrene. In that case, with handle section 12 fabricated from PVC material, the lower tubular handle section 12 can be quickly and effectively sealingly boned to spray head shell section 19 after insertion into boss 23 by means of a solvent cement, ultrasonic welding, or any other suitable means,. Bore 24 of boss 23 may be tapered to a slightly smaller diameter at its lower end, if desired, to form a tighter interference fit with the outer wall surface of lower tubular handle section 12, when the latter is inserted into the boss.

Figure 4:
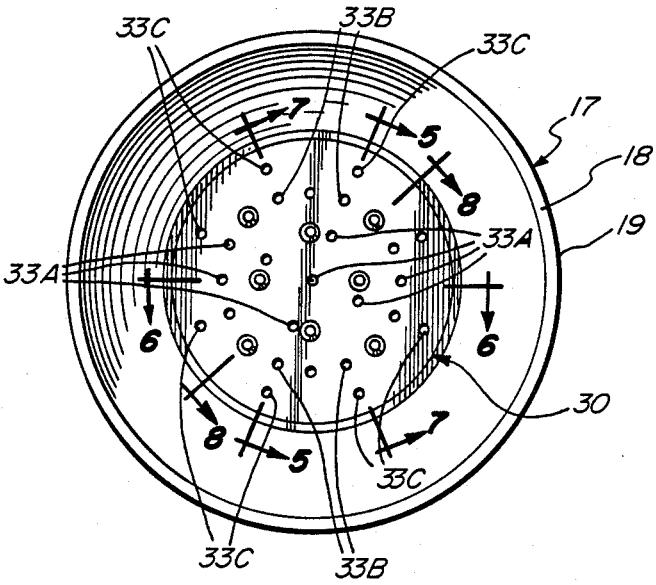
FIG. 4 is a bottom plan view of an orifice plate having spray orifices and spikes, and forming part of the spray head shell of FIGS. 2 and 3.

As may be seen best by referring to FIGS. 3 and 4, spray head 17 includes a circular disc-shaped orfice plate 30 of generally uniform thickness joined to the inner circumferential wall surface 22 of shell section 19 of the spray head. As shown in FIGs. 3 and 4, circular plate 30 is coaxially located with respect to the longitudinal axis of shell section 19 of spray head 17, and segments the inner space 21 of the shell section into a relatively large frusto-conic lower sub-space 31, and a smaller frusto-conic upper sub-space 32. Upper frusto conic sub-space 32 has a larger, or steeper cone angle than lower sub-space 31, and communicates at its upper, open end with lower opening 26 of bore 24 through boss section 23.

As shown in FIGS. 3 and 4, circular orifice plate 30 has a plurality of orifices 33 extending through its thickness dimension, communicating at their upper entrance openings with upper sub-space 32 within shell 19, and at their lower, exit openings with lower sub-space of the shell. Orifices 33 are provided to produce jets of water directed into the lower sub-space 31 inside spray shield shell 19, as is described in greater detail below.

Referring still to FIGS. 3 and 4, it may be seen that circular plate 30 has a plurality of tapered spikes 34 projecting axially downwards from the lower surface 35 of the plate. As shown in those figures, the spikes 34 are tapered to smaller diameter points at their lower end, and are adapted to penetrating piles of dried animal excrement. As may be seen best by referring to FIG. 4, spikes 34 are positioned at regular circumferential intervals on different diameter circles concentric with the axis of circular orifice plate 30. As shown in FIGS. 1 and 3, the lower pointed ends of the spikes 34 extend a slight distance, approximately ¼ inch for example, below the lower annular wall surface 18 of spray head shell 19, for a purpose described below.

Figure 5:
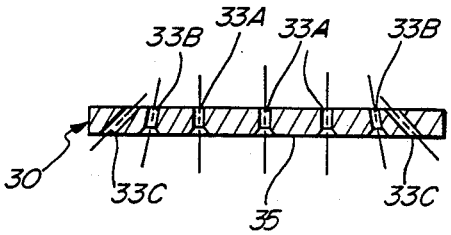
FIG. 5 is a first longitudinal sectional view of the orifice plate of FIG. 4, taken along line 5—5 of that figure.
Figure 6:
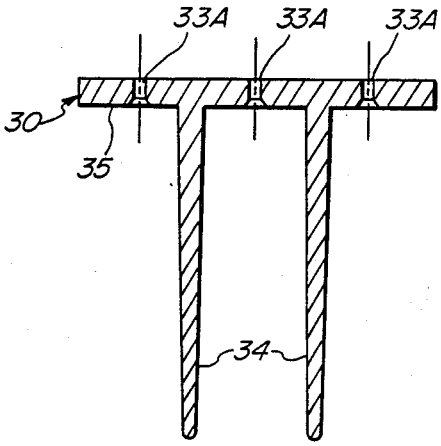
FIG. 6 is a second longitudinal section view of the orifice plate of FIG. 4, taken along line 6—6 of that figure.

As may be seen best by referring to FIGS. 4 through 8, the water jet orifices generally designated by the number 33 are of a variety of types. Thus, as shown in FIG. 5, circular orifice plate 30 has a central water jet orifice 33A and identical water jet orifices 33A spaced apart at regular circumferential intervals on a circle of small radius concentric with the axis of the plate and the single central orifice.

The bore axis of central orifices 33A are all perpendicular to the lower surface of circular orifice plate 30. Also, the orifices 33A taper to a larger diameter at the lower surface of plate 30, to give in sectional view the shape of cylindrical hole which is countersunk at its exit surface 35 of the hole.

Orifices 33A have enlarged diameter exit bore to preclude imperfections at the junction between the bore and the lower surfaces 35 of the orifice plate 30 from altering the desired flow pattern characteristics of water flowing through the orifices. Thus, if orifice plate 30 and spike 34 are integrally formed, along with orifices 33, as a single injection molded plastic part, molding flash formed at the junction of the orifices with the lower surface 35 of plate 30 will not adversely affect stream flow characteristics if the outlet opening of the orifices are enlarged over the bore diameter.

Figure 7:
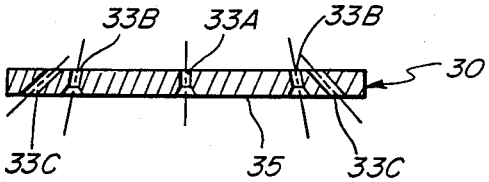
FIG. 7 is a third longitudinal sectional view of the orifice plate of FIG. 4, taken along line 7—7 of that figure.
Figure 8:
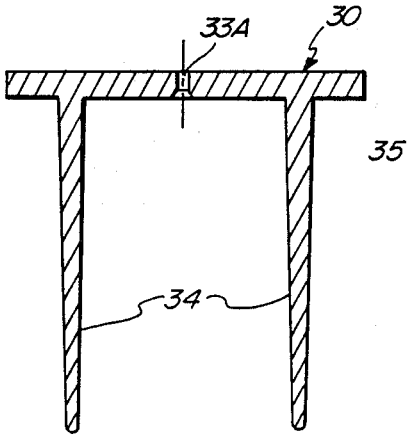
FIG. 8 is a fourth longitudinal sectional view of the orifice plate of FIG. 4, taken along line 8—8 of that figure.

As shown in FIGS. 3 and 7, a plurality of a second, intermediate, type water jet orifices 33B are located at regular circumferential intervals on a circle of somewhat larger diameter than the innermost circle on which central orifices 33A are located. Intermediate orifices 33B are similar in size and shape to central orifices 33A, and have an enlarged diameter exit bore. However, the bore axis of intermediate orifices 33B are inclined at a slight angle, typically 10 degrees, outwards from the central longitudinal axis of circular disc plate 30. Thus, streams of water issuing from these intermediate bores will have a radially outwardly directed component.

As shown in FIGS. 5 and 7, a plurality of a third, outer type of orifices 33C are located at regular circumferential intervales on an outermost circle concentric with the axis of circular orifice plate 30. Outer orifices 33C are not countersunk. Thus, the ninety degree intersection of the bore of outer orifices 33C with lower surface 35 of orifice plate 30, which may be roughened by flash, results in a divergent spray of water being developed at the exit bore of these outer orifices. Also, the bore axis of outer orifices 33C diverge about 45 degrees outwards from the bore axis of intermediate orifices 33B. This results in a spray pattern which impinges the lower inner surface of shell 19.

Orifice plate 30 is preferably injection molded from a durable, water resistant, relatively rigid material such as PVC, ABS or styrene plastic. As shown in FIGS. 3 and 4, circular orfice plate 30 is positioned within spray head shell 19 transversely to the longitudinal axis of the shell, with the outer circumferential surface of the plate sealingly joined to the inner circumferential surface of the inner wall 22 of the shell. Preferably, as shown in FIG. 3, an annular groove 36 is provided in inner wall 22 of the spray head shell 19 to receive circular orfice plate 30. Annular groove 36 is of slightly larger diameter than the outer diameter of orfice plate 30, is coaxial with the longitudinal axis of spray head shell 19, and is longitudinally positioned at the intersection between the small upper frusto-conic sub-space 32 and larger lower frusto-conic sub-space 31 within the spray head shell.

As shown in FIG. 3, annular groove 36 has an upper annular wall surface or shoulder 37 of smaller inner diameter than the outer diameter of orifice plate 30, thus forming a seating surface for the orifice plate when the plate is inserted upwards into the concave space 21 within the spray head shell 19. With the orifice plate seated within groove 36 and on shoulder 37, the outer edge of the plate is sealingly bonded to the spray head shell by use of solvent cement, ultrasonic welding, or any other suitable means.

The animal excrement dissolver 10 is used as follows: Referring now to FIG. 1, the male coupling B of a standard garden hose A which is coupled to a source of water under pressure, is screwed into the female garden hose coupling 16 of the angled upper section of handle section 11 of the dissolver. With shutoff valve 15 in its "off" position, hose A is pressurized with water. The spray head 17 is then lowered over the pile of animal excrement which it is desired to dispose of, and valve 15 turned to its "on" position.

In many cases, jets of water issuing from the novel structure and arrangement of orifices 33 is sufficient to quickly disintegrate the pile of animal excrement by hydrodynamic ablation action along. For extremely dry, hard piles of excrement, the spray head 17 may be repeatedly raised and lowered over the pile, the impacting action of the spikes 34 protruding from the lower end of the spray head shell 19 assisting the action of the water jets in breaking up the pile. The shell may be rotated above its longitudinal axis during impacting to assist the breaking action.

Use of the dissolver 10 as described above results in rapid and efficient disintegrating of a pile of animal excrement, and fluidization of the excrement into a water solution which is sufficiently diluted to have effective fertilization properties, without excessive chemical constituents which could "burn" foliage. Since the spikes 34, when contacting the ground, position the lower annular wall surface 18 of the spray head shell 19 about one-quarter inch above the ground, a space is thereby formed which allows water and fluidized excrement to flow radially from underneath the shell onto the surface of the lawn or ground. The novel configuration of orifices 33 within spray head shell 19 provides at once effective hydrodynamic ablation of excrement, cleansing of the interior parts of the spray head, and confinement of the water stream onto a focused column which minimizes the possibility of water spraying into the operator.

After the dissolver 10 has been used to dissolve animal excrement as described above, the spray head 17 may be raised above the ground and used as conventional spray device to wash the grass in the region formerly occupied by the pile.

What is claimed is:

1. An apparatus for dissolving and flushing away animal excrement left on a surface comprising;

a. an elongated hollow tubular handle section provided with an axial bore having an upper opening at one end of said handle section, and a lower opening at the lower end of said handle section, b. means for introducing fluid under pressure into said upper opening of said handle section, c. a generally frusto-conically shaped spray head shell having a hollow interior space, said spray head shell being fastened at its upper, smaller diameter end to the lower end of said handle section so as to sealingly couple said lower end of said bore and said handle section with said hollow interior space of said spray head shell, and d. a relatively thin orifice plate of generally uniform thickness sealingly joined at its outer perimeter surface to the inner wall surface of said spray head shell, said plate being located transversely to the longitudinal axis of said spray head shell, said plate having a plurality of orifices through its thickness dimensions, and said plate having a plurality of spike-like appendages protruding perpendicularly downwards from the lower surface of said plate.

2. The apparatus of claim 1 wherein said spikes protrude below the lower annular wall surface of said spray head shell.

3. The apparatus of claim 1 wherein said spray head shell is further defined as having at its upper, smaller diameter end an upwardly protruding hollow cylindrical boss section having a cylindrical bore adapted to insertingly receive the lower end of said handle section.

4. The apparatus of claim 3 wherein said spray head shell is further defined as having near the lower end of said bore of said boss section, a radially inwardly projecting flange section having an upper shoulder adapted to butt up against the lower annular wall surface of said hollow tubular handle section, thereby providing a seating surface for limiting downward movement of said handle section into said bore of said boss section.

5. The apparatus of claim 4 wherein said flange section is further defined as an annular-shaped flange.

6. The apparatus of claim 5 wherein said spray head shell section is further defined as having in its inner wall surface near the smaller diameter upper end of said spray head shell section, an annular shoulder adapted to seat against, and limit further upward movement of, said orifice plate.

7. The apparatus of claim 6 wherein said spray head shell is further defined as being a single formed piece.

8. The apparatus of claim 7 wherein said spray head shell is further defined as being an injection molded plastic part.

9. The apparatus of claim 6 wherein said orifice plate is further defined as being a single formed piece.

10. The apparatus of claim 9 wherein said orifice plate is further defined as being an injection molded plastic part.

11. The apparatus of claim 10 wherein the lower ends of said spikes projecting perpendicularly downwards from the lower surface of said plate extend below the lower annular wall surface of said spray head shell.

12. The apparatus of claim 10 wherein said orifice plate is further defined as having a center orifice, a first plurality of a first, inner type of orfices spaced at regular circumferential intervals located on a first circle concentric with said center orfice, a second plurality of a second, intermediate type of orifices spaced at regular circumferential intervals located on a second circle of larger diameter than, and concentric with said first circle, and a third plurality of a third, outer type of orifices spaced at regular circumferential intervals located on a third circle of larger diameter then, and concentric with said first and second circles.

13. The apparatus of claim 12 wherein said center orfice has a cylindrical upper entrance bore which tapers to a larger diameter exit opening in the lower surface of said surface plate.

14. The apparatus of item 13 wherein said inner orifices each have a cylindrical upper entrance bore which tapers to larger diameter exit opening at the lower surface of said orifice plate.

15. The apparatus of claim 13 wherein said intermediate orifices each have a cylindrical upper entrance bore which tapers to a larger diameter exit opening at the lower surface of said orifice plate.

16. The apparatus of claim 15 wherein the axes of said bores of said intermediate orifices are inclined radially outwards at an angle from the longitudinal axis of said orifice plate, so as to place the exit openings of said bores further from said longitudinal axis than said entrance openings of said bores.

17. The apparatus of claim 16 wherein said inclination angle is approximately ten degrees.

18. The apparatus of claim 17 wherein the axes of said bores of said outer orifices are inclined radially outwards at an angle from the longitudinal axis of said orfice plate, so as to place the exit openings of said bores further from said longitudinal axis than said entrance openings of said bores.

19. The apparatus of claim 17 wherein said inclination angle is approximately fifty-five degrees.

* * * * *